United States Patent [19]

Stock et al.

[11] 4,030,708

[45] June 21, 1977

[54] PROCESS FOR INTRODUCING PARTICULATE MATERIAL INTO A CONTAINER

[75] Inventors: Arthur J. Stock, Lakewood; Donald E. Christofer, Willowick; Joseph E. Brinza, Euclid, all of Ohio

[73] Assignee: Stock Equipment Company, Cleveland, Ohio

[22] Filed: Mar. 24, 1976

[21] Appl. No.: 669,906

Related U.S. Application Data

[62] Division of Ser. No. 409,386, Oct. 25, 1973, Pat. No. 3,966,175, which is a division of Ser. No. 182,088, Sept. 20, 1971, Pat. No. 3,835,617.

[52] U.S. Cl. ..... 259/8; 137/578; 259/154

[51] Int. Cl.[2] ..... B01F 3/12

[58] Field of Search ..... 259/7, 8, 65, 66, 149, 259/154; 137/578

[56] References Cited

UNITED STATES PATENTS

| | | | |
|---|---|---|---|
| 1,367,823 | 2/1921 | Lyons | 137/578 |
| 1,621,959 | 3/1927 | Snow | 137/578 X |
| 2,600,039 | 6/1952 | Whaley, Jr. | 73/440 X |
| 3,608,869 | 9/1971 | Woodle | 259/7 |
| 3,948,490 | 4/1976 | Troope | 259/65 X |

*Primary Examiner*—Richard C. Queisser
*Assistant Examiner*—Daniel M. Yasich
*Attorney, Agent, or Firm*—Bosworth, Sessions & McCoy

[57] ABSTRACT

Apparatus is disclosed for disposing of radioactive waste materials by placing them into a steel drum together with cement and water, mixing the contents, and then storing the drum for a period of time to permit partial decay of radioactive materials. Also disclosed are a decanting tank for forming a dispersion of radioactive resin particles and water in predetermined proportions, said tank having an internal mixer to effect stirring, means for sensing the levels of the water and the resin particles, and means for removing excess water by decanting.

13 Claims, 10 Drawing Figures

243
330
338
339e
339
215
231
244
344
345
345e
242
243e
226
228
229
451
461
457
452
214
453

PROCESS FOR INTRODUCING PARTICULATE MATERIAL INTO A CONTAINER

REFERENCE TO RELATED APPLICATION

This application is a division of our copending application Ser. No. 409,386 filed Oct. 25, 1973 and issued as U.S. PAT. No. 3,966,175, which was a division of and was copending with our application Ser. No. 182,088 filed Sept. 20, 1971 and issued as U.S. Pat. No. 3,835,617.

BACKGROUND OF THE INVENTION

This invention relates to apparatus and method for disposition of radioactive waste materials.

While the invention may be used for the packaging and disposition of various types of radioactive or chemically dangerous wastes, it can be exceptionally advantageously employed in the disposition of radioactive wastes as they occur in nuclear electric power generating stations.

In both boiling water and pressurized water reactors of nuclear power plants, it is a practice to subject the water to cleaning action by passing it through beds of ion-exchange resins. Through chemical and filtering action, they remove dissolved and suspended impurities, thus maintaining the water and at the desired high purity. Resin particles of one type widely used for this purpose are those approximately 20 mesh in size. Resin particles of another widely used type are much smaller, approximating 300 mesh in size.

The contaminated resins of either type are removed from the water treating vessel by sluicing them out with water. The resulting slurry or dispersion is collected in a waste resin tank at the plant. The apparatus disclosed hereafter is particularly well adapted for disposition of this type or radioactive slurry.

Stringent laws, rules and regulations govern the disposition of radioactive wastes and their transportation over highways, on railroad and by other modes of transportation. In general, the material must be shielded so that radiations emanating from the material do not exceed maximum levels established by the laws and regulations. It has therefore been proposed to provide a mixture of resin particles containing radioactive material, cement as a solidifying agent, and water in a container such as a steel drum, and to allow the mixture to solidify in the drum.

However, prior systems for putting radioactive materials into a drum or other container in general require that operators and maintenance personnel be exposed to radiation, even though such system may be intended to protect personnel. For example, the operators in many cases must go into areas containing radiation to open drums or close them or to insert nozzles in the drums or to handle the drums in storage.

Moreover, prior systems do not in general provide desired close control to insure that proper amount of radioactive material, cement, or water are put into the drum to insure proper solidification of drum contents. It is imperative to avoid improper loading of the drum or mixing of drum contents. Previous systems did not provide for an accurate weight of resin to a weight of cement ratio in order to insure that the drum contents would be properly solidified with the most economical use of cement and with the lowest transportation costs. In prior systems that filter the resin in the drums to remove water, costs are understandably higher for the drum because of the added equipment contained herein.

Some prior systems mix radioactive resins, cement and water in a mixture outside of a drum. This involves exposure of considerable amounts of equipment to radioactivity and possibilities of considerable exposure of personnel to radioactivity. Moreover, the mixer must be cleaned after each use, which is difficult because the cement stricks to the mixer; moreover, the mixer will become radioactive and hence unsafe in time considerably shorter than the life of the plant, necessitating replacement expense. Some prior systems mix these materials in the drum; but if an open top drum is used, considerable spillage occurs during mixing, and if the drum is rolled about its lengthwise axis to mix its contents a core or poorly mixed materials is formed in the center of the drum.

SUMMARY OF THE INVENTION

It is a general object of the present invention to overcome the above and other problems relating to the disposition of radioactive waste materials. A further object is the provision of apparatus and methods for overcoming as many as desired of the above indicated problems, as well as other problems. Another object is to provide apparatus and methods in which fluent materials containing radioactive or other dangerous materials can be placed and mixed in containers along with, if desired, solidifying agents such as cement or asphalt or plastics. A further object is to provide apparatus for carrying out such operations by remote control so personnel need not be exposed to radiation during operations and to very little if any radiation during maintenance of equipment. A further object is provision of apparatus which can be easily repaired or maintained with little if any exposure of personnel or surrounding environment to hazaradous radiation.

To accomplish these and other objects, the present invention provides apparatus and methods for packaging fluent material such as dangerous or radioactive liquids, or slurries containing radioactive or otherwise dangerous particulate material without human handling or the necessity of personnel connecting pipes or the like, comprising means controllable by remote control for moving a container into any of a variety of preselected positions; means controllable by remote control for introducing into a container in a preselected loading position an essentially predetermined amount of such fluent material in which preferably the proportion of liquid to radioactive or other dangerous material is accurately predetermined; means controllable by remote control for closing the container; means controllable by remote control for agitating the container to mix thoroughly the contents thereof; and means to receive the closed container containing its mixed contents, such means being at a location away from the locations at which the liquid is introduced into said container and the location in which the container is agitated.

In accordance with the invention, a mixture or slurry of radioactive particles and liquid is fed to a decanting tank and allowed to settle to form a first level of a dispersion of finely divided particles and liquid and another level above said first level of liquid having a lower specific gravity than that of said dispersion. Sensing means are provided in the tank to determine the height of each level and to send a signal to a location outside of the tank indicating such heights.

A decanting pipe then draws off excess liquid in accordance with the indicated levels to provide a desired proportion of total liquid to total particles in the tank. The sensing means are withdrawn, the mixture in the tank is agitated, and the resulting dispersion is fed in accurately measured amounts by metering pump means to storage drums containing cement or other solidifying agent. Means are provided for weighing each drum before it is filled or after it has been closed to check on the amount of material introduced.

BRIEF DESCRIPTION OF THE DRAWINGS

These and other objects and features of the invention will be apparent from the following description of a preferred embodiment of the invention in connection with the accompanying drawings in which.

DISCLOSURE OF PREFERRED EMBODIMENT

General Arrangement

Figure 1:
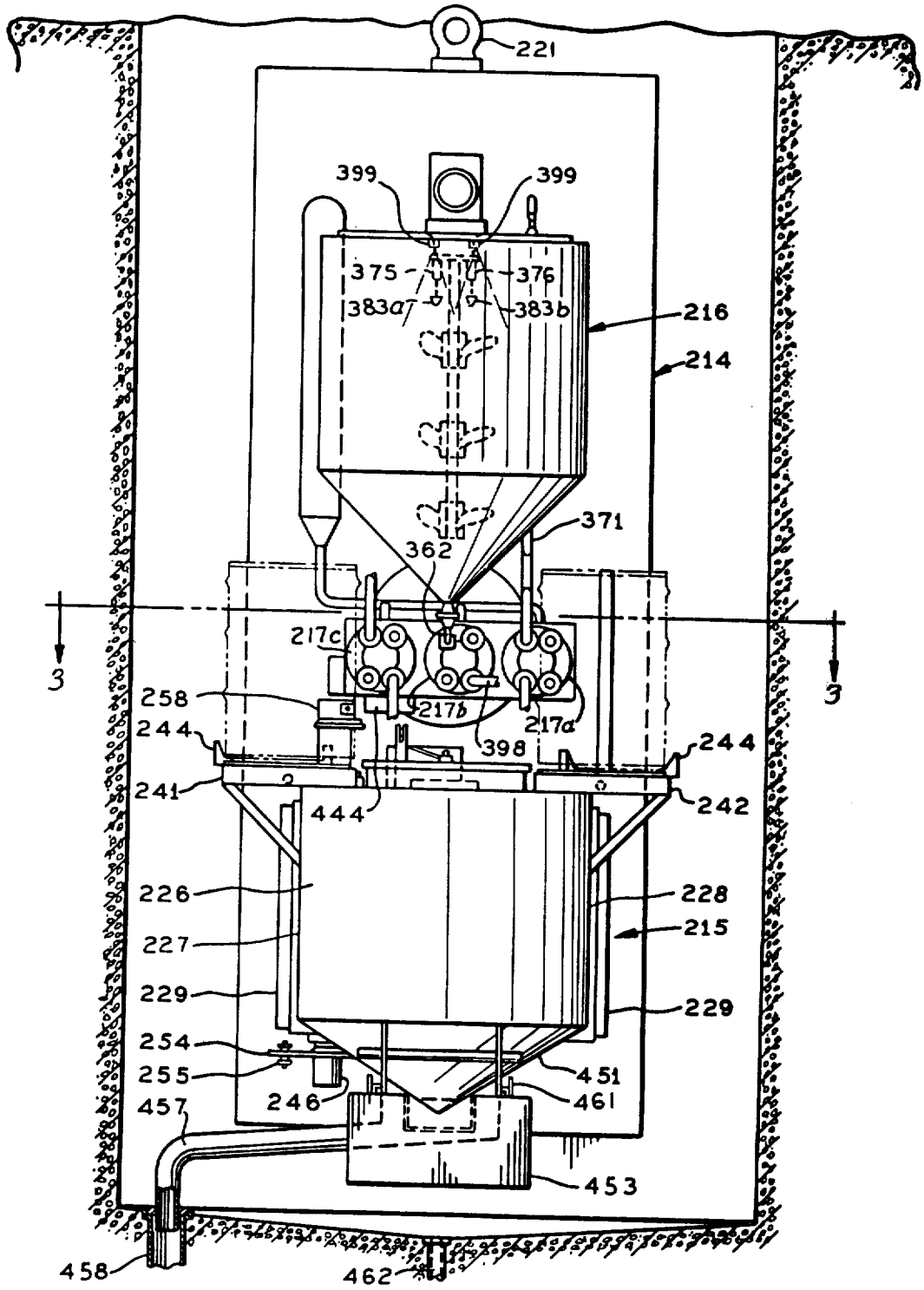
FIG. 1 is a front elevational view on a reduced scale of the drumming apparatus of the present invention.

For illustrative purposes, the below described embodiment of the invention will be described in connection with the disposition of radioactive waste material in the form of resin particles containing radioactive materials like those described above, and in the form of evaporator bottoms, by putting the radioactive material including water, and cement as a solidifying agent, into a steel drum; mixing these materials in the drum; moving the drum into storage; allowing the mixture to solidify and radioactivity to decay in storage; and then moving the drum to a vehicle for transportation.

For convenience, the term "drum" is used hereafter to designate steel drums or barrels as such, as well as suitable other types of containers for the indicated purposes. While for convenience cement is disclosed as the solidifying agent and water as the liquid, it is to be understood that other suitable types of solidifying agents such as asphalt or certain natural or synthetic resins, and that suitable liquids other than water, may be used.

The reference numerals used herein and the terminology employed correspond to those used in U.S. Pat. No. 3,835,617 the entire disclosure of which is hereby incorporated by reference and made a part of the disclosure of the present application.

Shield Wall

Drumming Station: General Arrangement of Drumming Station

The apparatus in the drumming station illustrated in FIGS. 1–4 comprises four basic components: a metal shield wall 214, drumming equipment 215, a decanting tank 216 and a set of metering pump 217*a*, *b*, *c*.

The shield wall 214 serves as a locating and anchoring means for the other components 215, 216, 217*a*, *b*, *c*. It is formed of strong metal to support the other components and to serve as a barrier to stop the escape of harmful radiation from the side of the shield wall carrying these components to the other side. The shield wall may be of any of various thicknesses, depending on the intensity of radiation expected to be encountered; since it is formed of metal its thickness is substantially less than conventional shielding such as concrete; moreover the faces of the shield wall may be machined, drilled and bored to present accurate surfaces for equipment mounting and uniform smooth surfaces for cleaning if required. Use of the metallic shield wall and its resulting lesser thickness simplifies drive connections and maintenance work done through the shield wall. A shield wall of steel approximately 12 inches thick is advantageous for most uses of the invention.

The shield wall is rigidly but demountably attached to the concrete building wall by an accurately machined, grounted in frame 218 (FIGS. 2,3) surrounding wall opening 219 to which the shield wall is secured by bolts and nuts 220 on the safe side of the shield wall. Preferably, the shield wall can be demounted with the other components still attached, and bodily removed as by an overhead crane to a remote location for maintenance or repair; the cantilever mounting of the components mounted on the shield wall, as described below, facilitates this; the cantilever supporting of components also eliminates floor supports and facilitates cleaning. The shield wall preferably overlaps the opening 219 to provide an offset joint that prevents possible radiation leakage around the shield wall edges.

Figure 2:
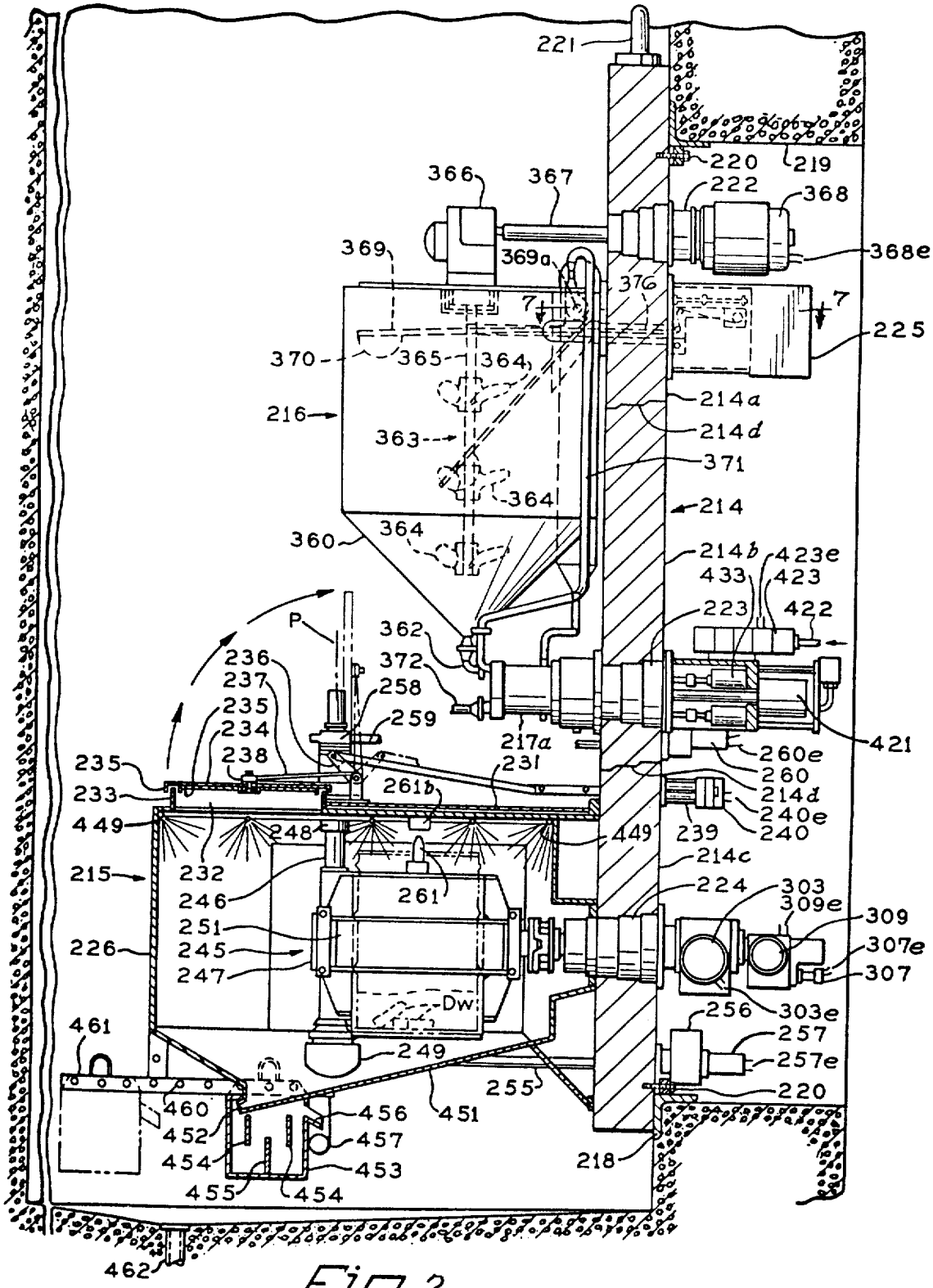
FIG. 2 is a side view of the drumming apparatus, parts being broken away to show the interior mechanism in the housing.

The shield wall may be divided into sections 214*a*, 214*b*, 214*c*, by transverse joints 214*d* to facilitate easier handling and shipping. These joints are offset or stepped as shown in FIG. 2 to prevent radiation leakage outwardly to the safe side of the shield wall outside of the drumming station. As explained later, parts such as drives that pass through the shield wall are also sealed to removable plugs, as at 222, 223, 224 that form similar offset or stepped joints to prevent radiation leakage. Where space or design does not permit sealing to an offset or stepped plug, a secondary shield 225 is provided to block radiation escape.

Drumming Equipment

The drumming equipment 215 illustrated comprises a closed housing 226 supported from the side of the shield wall facing into the drumming station. This housing (FIGS. 1–4) has upstanding sides 227, 228 carrying detachably mounted access plates 229. The top 231 of the housing has a hatch opening 232 surrounded by upward flange 233, closed by a hinged hatch cover 234 having inner and outer downward flanges 235 that overlap flange 233 in the closed position to prevent escape of radioactive material. The housing and hatch cover when closed provide a closed enclosure in which drum loading and mixing occurs. The hatch cover permits access to the enclosure for introduction or removal of drums, while preventing escape into the atmosphere of air displaced by materials loaded into the drum, and while preventing escape of radioactive material due to splashing should the drum being processed develop a leak or should material be accidentally spilled during the loding operation. Hatch cover 234 can be moved to closed and open positions by a lever 236 pivotally supported on housing 226 and is rigidly secured to an arm 237 carrying the hatch cover through a resilient connection 238. Lever 236 is actuated from the safe side of the shield wall by a known fluid-operated cylinder 239, the fluid valves 240 of which are controlled by known means **240*e* from a control station (not shown) as described in U.S. Pat. No. 3,835,617. The cylinder is spring loaded to close the hatch if the energizing fluid fails, for safety; the spring load can be overridden by hand or by mechanical means. Housing 226 has a venting conduit 226*a*** preferably connected to a closed venting system.

A fixed loading dock 241 is externally mounted at one side of the housing 226 and is adapted to support a drum to be filled that is first deposited by the overhead crane on this dock. A fixed unloading dock 242 is externally mounted on the other side of housing 226; a drum removed from housing 226 is set by the crane on this unloading dock, and the intensity of radiation emanating from the drum is measured by known radiation monitor means 243 that sends by known means **243*e* electrical signals to the control, shown in FIGS. 1 and 50 to 51 inclusive of U.S. Pat. No. 3,835,617, where the information is noted. Each of the loading and unloading docks carries a scale 244** connected with known means for reporting the scale reading to the control station.

Inside of drumming equipment 215 is a drum positioner cradle mechanism 245 adapted to carry a drum and move it (FIG. 3) about a vertical axis P from a drum loading and unloading position I, then to a first intermediate position II in which the drum is clamped into its cradle in a vertical position, then to a second intermediate position III in which the drum is opened by unscrewing and removing its cap, then to a third intermediate position IV where the drum is filled then back to intermediate position III in which the drum is closed or capped, then to intermediate position II where the drum is turned end-over-end to agitate and mix its contents from which position the cradle returns the drum to location I under the hatch from where the drum can be removed by a crane. The cradle mechanism comprises a vertical shaft 246 (FIGS. 1–3) on which a cradle frame 247 is rigidly mounted; the shaft is rotatably and vertically slidably mounted in bearings 248, 249 mounted at the top and bottom of housing 226. A cradle 251 rotatably supported in the cradle frame by bearings for rotations about a horizontal axis H on its cradle frame which thus forms a trunnion in which the cradle can be rotated to impart to the drum the desired end-over-end motion to thoroughly mix the contents of the drum, tumbling movement of the loose mixing weights Dw in the drum aiding this mixing.

The cradle frame 247 is moved to angular positions I, II, III, IV indicated above by actuating means (FIGS. 1, 2) comprising a lever arm 254 rigidly mounted on the lower end of shaft 246 and pivotally connected to a rod 255 that may be reciprocated as required by a known mechanism 256 driven from an electric motor 257 energization of which is controlled by known means **257*e* from the control station. The linear travel provided by mechanism 256 may be controlled by known means accurately to stop the cradle in the various angular positions as described above The cradle frame 247, its supporting shaft 246 and cradle 251 carrying a drum can be raised and lowered as required to permit movement of the cradle and performance of necessary steps in the positions I–IV, by a known type of screw jack mechanism 258 (FIGS. 1, 2, 3) actuated by a drive shaft 259 extending through the shield wall to its safe side. Shaft 259 is rotated as required by a gear box electric motor combination 260, controlled by known means 260*e*** from the control station to raise the cradle to an upper elevation referred hereafter as the U elevation in positions III and IV, and to lower the cradle to a lower elevation hereinafter referred to as the L elevation for movement between the positions and for operating in positions I and II.

When the cradle frame 247 is raised to elevation U in either of positions III or IV, an upwardly projecting tapered dowel pin 261 fixed to the top of the cradle frame engages in the opening **261*a* of the appropriate one of two hardened steel bushings 261*b* in the top wall 231 of the housing 226**. This assures accurate and positive location of the cradle in positions III and IV for the filling and capping operations that are carried out in these positions.

Power means are provided for rotating the cradle when it is in position II-L including an electric motor 303 (FIG. 2) controlled by known means **303*e*** from the control station.

Means are provided for actuating the clamping arms including a double acting fluid operated cylinder 307 controlled by conventional means **307*e* from the control station. Rotatable means are provided to clamp or unclamp the drum including an electric motor 309 controlled from the control station by suitable known means 309*3***.

The drumming station also includes cap handling means 320 for removing and replacing a screw cap in the top of a drum, as described in U.S. Pat. No. 3,835,617. After the drum is at position III for cap removal, the cradle frame 247 is raised to elevation U to raise the drum D carried by the cradle 251 so its screw cap can be engaged by means 320.

When brought into the drumming station according to the illustrative process, each drum will contain a preloaded accurately determined amount of cement or other solidifying agent D*a* and one or more freely movable mixing weights D*w* which may take the form of oblong pieces of steel about 1½ × 1½ × 6 inches in dimensions; a cap 321 closes the drum.

The drum, which is of generally cylindrical form, has (FIG. 6) a cap opening structure C at the center of the top wall 322 of the drum, comprising a steel collar 323 having an internal threaded opening 324, fixed in the top wall 322 of the drum. Collar 323 has a radial flange 325 around the outer edge of which the top wall metal is crimped at 326 to hold the collar securely in the drum. The internally threaded opening 324 is adapted to be closed by a screw cap that has an external thread that permits the screw cap to be screwed into the threaded opening.

Figure 5:
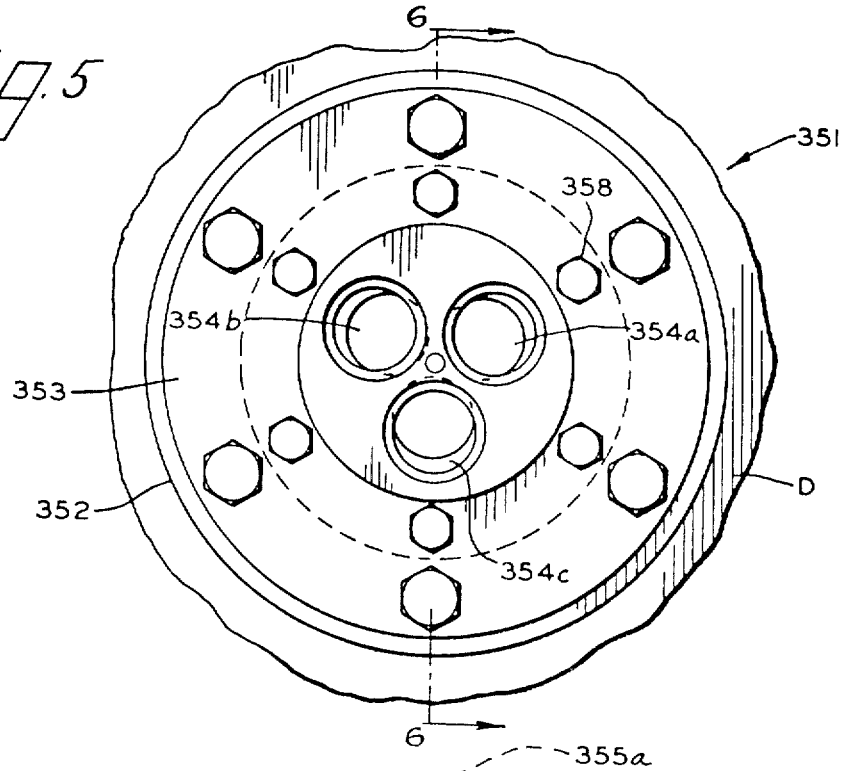
FIG. 5 is an enlarged plan view of the filler nozzle for filling a drum while it is in the drumming apparatus.

After the screw cap has been removed at position III the drum is ready to have the radioactive material put in it. This is accomplished by locating the drum carryng cradle 251 in the filling position IV and lifting the cradle and drum to engage the opening 324 with the fill nozzle 351 (FIGS. 3, 5, 6) in the top wall 231 of housing 226. Nozzle 351 comprises a mounting boss 352 fixed to the top wall 321 and rigidly detachably carrying a nozzle portion 353 having a tapered lower end adapted to project through opening 324 into the drum D, and carrying several downwardly through openings 354*a, b, c;* 354*a* being for introduction into the drum of radioactive resin dispersion from the decanting tank, 354*b* for evaporator bottoms, and 354*c* being for venting during filling, being connected by conduit 354*d* to a closed venting system, not shown. The nozzle portion also has a smaller opening 355 that may be connected to means 355*a* for sensing the level of liquid in the drum, such as known means for sensing back pressure when the drum has been filled to the level of the bottom opening of vent 355.

Nozzle portion 353 slidably carries a collar 356 that is biased downwardly by compression spring 357 and downwardly limited by stop bolts 358. Collar 356 engaged the drum top and seals with collar sealing ring 359 around the drum opening 324 to insure venting through the proper passage and prevent splashing or leakage during the filling operation. Openings 354*a* and 354*b* in the nozzle will be respectively connected to a decanting tank and to a source of evaporator bottoms through metering pumps to be described later.

Decanting Tank

Decanting tank 216 (FIGS. 1, 2, 10) is a closed tank formed of corrosion resistant durable metal, such as stainless steel, and is cantilever supported from shield wall 214. The tank has a frusto-conical lower portion 360 to aid in emptying material from the tank. A dispersion or slurry or radioactive resin particles in water is supplied to the tank from a suitable source such as pipe 361 (FIG. 10) connected to a plant holding tank, by pump 217*b* connected to pipe 362 opening into the bottom of tank 216. The decanting tank has an internal mixer 363 for stirring the material in the tank when desired. That shown (FIGS. 1, 2) comprises three propellers 364 mounted on a common shaft 365 rotatable about a vertical axis aligned with the central axis of the tank. This shaft is rotated through a gearbox 366 by a drive shaft 367 extending through the shield wall from an electric drive motor 368 on the safe side of the shield wall. As desired the motor can be energized and controlled from the control station by conventional means 368*e* to cause propellers 364 to mix thoroughly the material in the tank, regardless of the level of materials in the tank.

Tank 216 also has means for providing an adequate supply to the drumming station of a mixture of radioactive containing resin and water in a predetermined proportion. In general, the slurry supplied to the decanting tank contains excess water; and the decanting tank includes means for removing excess water by decanting.

A dewatering or decanting pipe 369 is pivotally mounted in the tank at its inner end by a leakproof joint 369*a*. The outer end of the pipe 369 carried a float 370 so that the end of said pipe can rise and fall with the liquid level, thus permitting decanting and removal of only the excess water. A conduit 371 connects the inner end of pipe 369 to one of the metering pumps 217*a* the outlet of which is connected by pipe 372 through a fine strainer 373, such as 100 microns, to an outlet pipe system 374 forming part of a plant equipment drain system.

Figure 10:
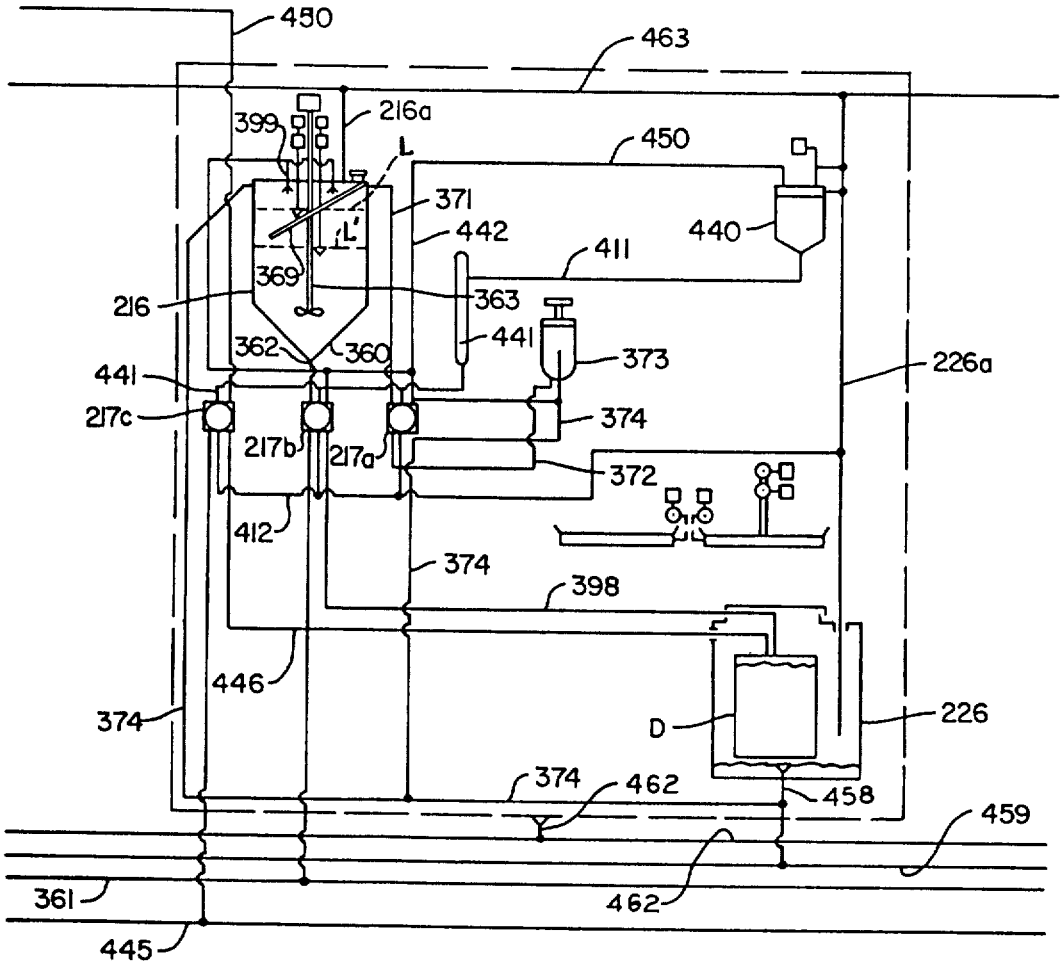
FIG. 10 is a schematic piping diagram for a drumming station.

The levels L and L′ of the water and of the radioactive resin particles shown by the dotted lines in FIG. 10 in the decanting tank 216 are sensed by sensors 375, 376 (FIGS. 2, 7–9) that transmit electrical signals giving information as to levels to the control station. Both sensors are identical except for the specific gravities of their floats 383*a* and 383*b*, so only sensor 375 for sensing the water level will be described in detail. This sensor comprises a frame 377 having a lateral portion 378 that extends through an opening through a stepped plug 379 in shield wall 214 and through a housing 380 into the tank. Frame 377 is pivotally mounted between its end at the end portion 378 on a bracket 381 fixed outside of wall 214.

The outer end of frame portion 378 carries a pulley 382 over which passes a strand 383 such as a stainless steel cable or wire, that at its free end suspends a float 383*a* and extends along the frame and around intermediate pulleys 384 to a winch drum 385 that is driven by a motor 386 mounted on the inner end of frame 377. Frame 377 includes an upwardly extending portion 387 adapted to bear against an adjustable stop 388 on the outside of shield wall 215 and carrying a rearward portion 389 on which the winch and motor are mounted. Portion 389 also carried adjustable balance weight 391 threaded on support 392 extending above portion 389 to permit accurate balancing of the pivotally mounted frame 377 and its associated apparatus. Stop 388 when engaged by frame portion 387 limits tilting of frame 375 about its pivot support in a direction that causes the outer end of frame portion 378 to move downwardly. Frame 377 also rigidly carries a transversely extending metal member 393 adapted alternately to actuate proximity switches 394 and 395, depending on the position of the frame and hence of member 393.

As shown (FIGS. 7, 8) the other sensor unit 376 is substantially identical, except that its electric motor and winch extends in the opposite direction transversely of frame member 377 to conserve space, and except that its float 383*b* has a different specific gravity than float 383*a* of sensor 375.

Float 383*b* may have a specific gravity of about 0.5 and is used to determine the level of the surface of the water in tank 216.

Float 383*a* has a specific gravity of approximately 1.05 so that it will sink in the water but will float at the surface L′ of the resin in the tank.

When tank 216 is filled, and also when the resin and water are being mixed in the tank by agitator 363 both floats 383*a* and 383*b* are raised to the top of their travel by their winch drums 385 and motors 386. When the float of a sensor is in its uppermost position with the float unsupported by liquid, the weight of the float causes the frame portion 378 to tilt downwardly until frame portion 387 contacts 388. This causes member 393 to actuate upper switch 394. Circuitry is provided so that if the circuit is energized from the control station, actuation of upper switch 394 energizes the motor 386 of the sensor to rotate its winch to lower the float. When the float floats, its weight is removed from the frame 377, which then tilts the other way around its pivot support until member 393 actuates lower switch 395. This stops the motor.

Each motor 386 has on its shaft a notched rotor 396 so designed that when its notches pass a conventional electronic pickup 397 electrical pulses are generated that are transmitted to the control station through circuit means 397 including conventional electronic counting means that makes it possible to determine the distance down to the float elevation and hence the level of the liquid on which the float floats.

Both sensors operate in essentially identical manner, except that the float of one has a specific gravity such that it detects and senses the level of water, while the other senses the level of the resin particles after they settle.

The operator at the control station can therefore determine, as from a predetermined curve or chart, the amount of water that should be left with the resin to provide the desired proportion of radioactive resin particles to the water. He can then actuate metering pump 217*a* (FIG. 10) to remove excess water through the floating end of decanting pipe 369, conduit 371, pump 217*a*, strainer 373 and conduit 374 until the desired level is reached, as indicated by the sensors 375, 376 to provide a dispersion in the tank of the desired predetermined proportion of water to resin particles.

Figure 3:
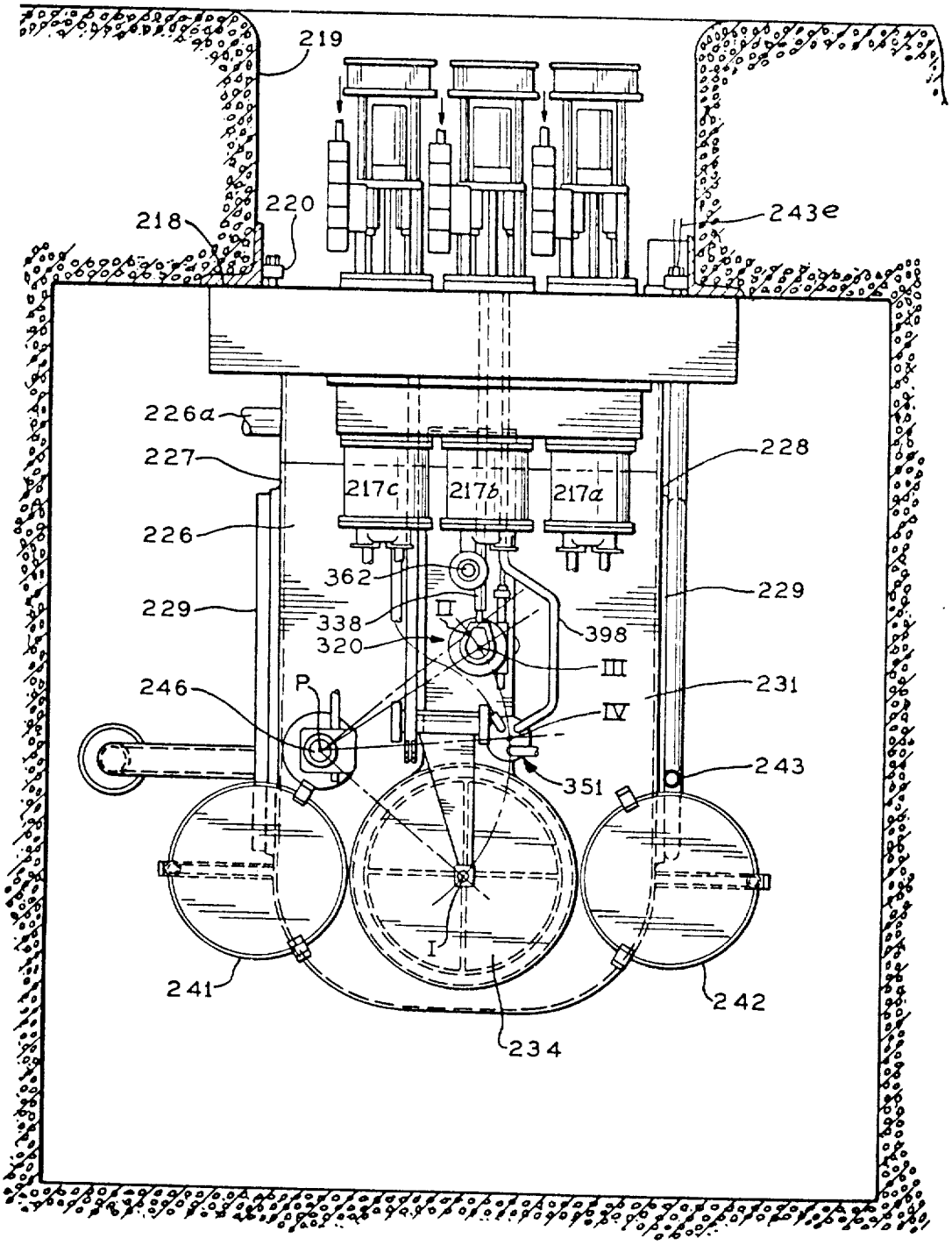
FIG. 3 is a plan view along line 3—3 of FIG. 1 and to a somewhat larger scale, parts, mostly piping, being omitted for the sake of clearness.
Figure 4:
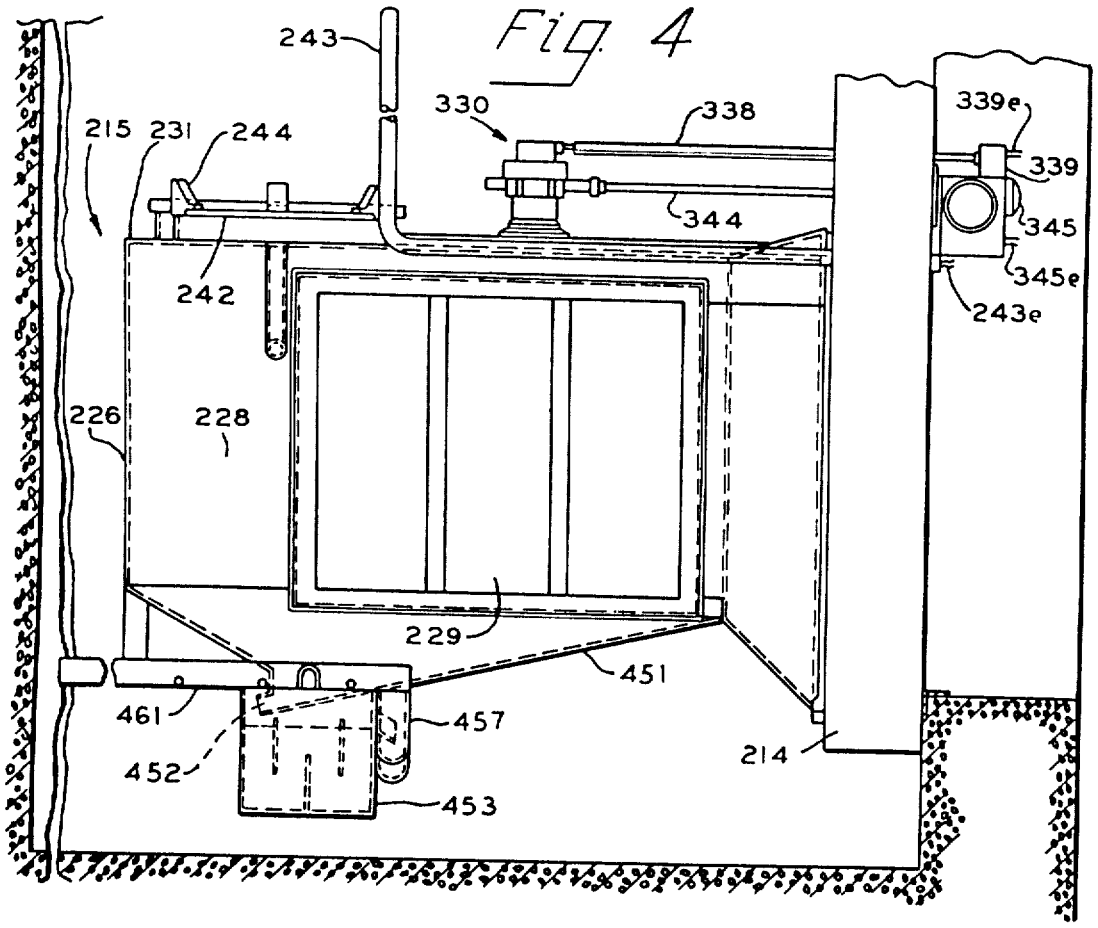
FIG. 4 is a side elevation of the lower portion of the drumming apparatus, in general corresponding to the side elevation of FIG. 3.
Figure 6:
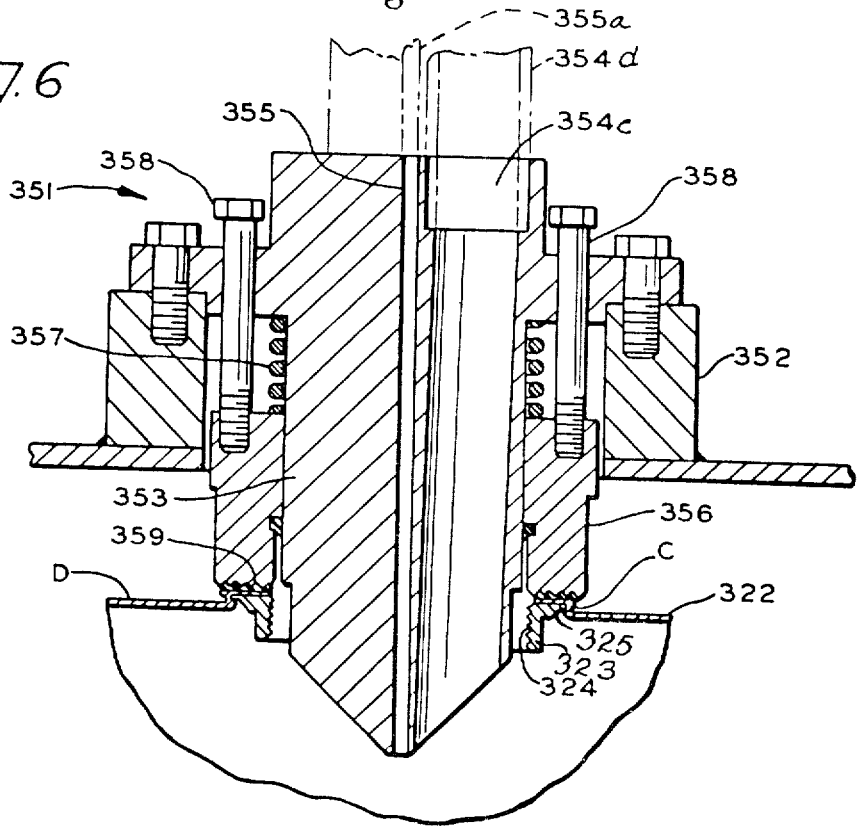
FIG. 6 is a section along line 6—6 of FIG. 5.
Figure 7:
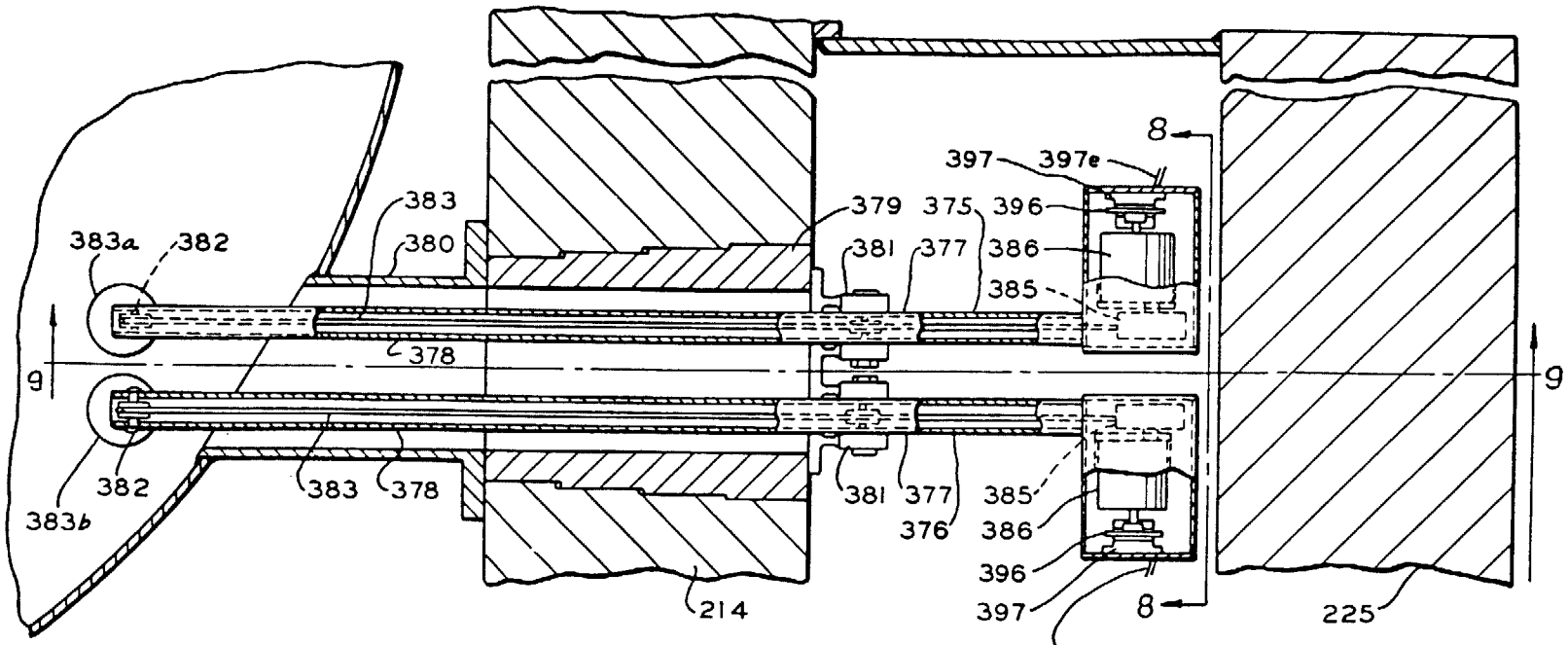
FIG. 7 is a sectional elevation along line 7—7 of FIG. 2 and to a considerably larger scale, of two liquid level sensors for the decanting tank.
Figure 8:
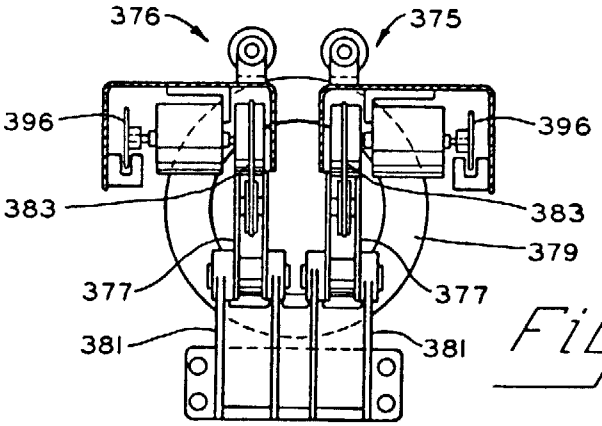
FIG. 8 is a view along line 8—8 of FIG. 7 and to the same scale.
Figure 9:
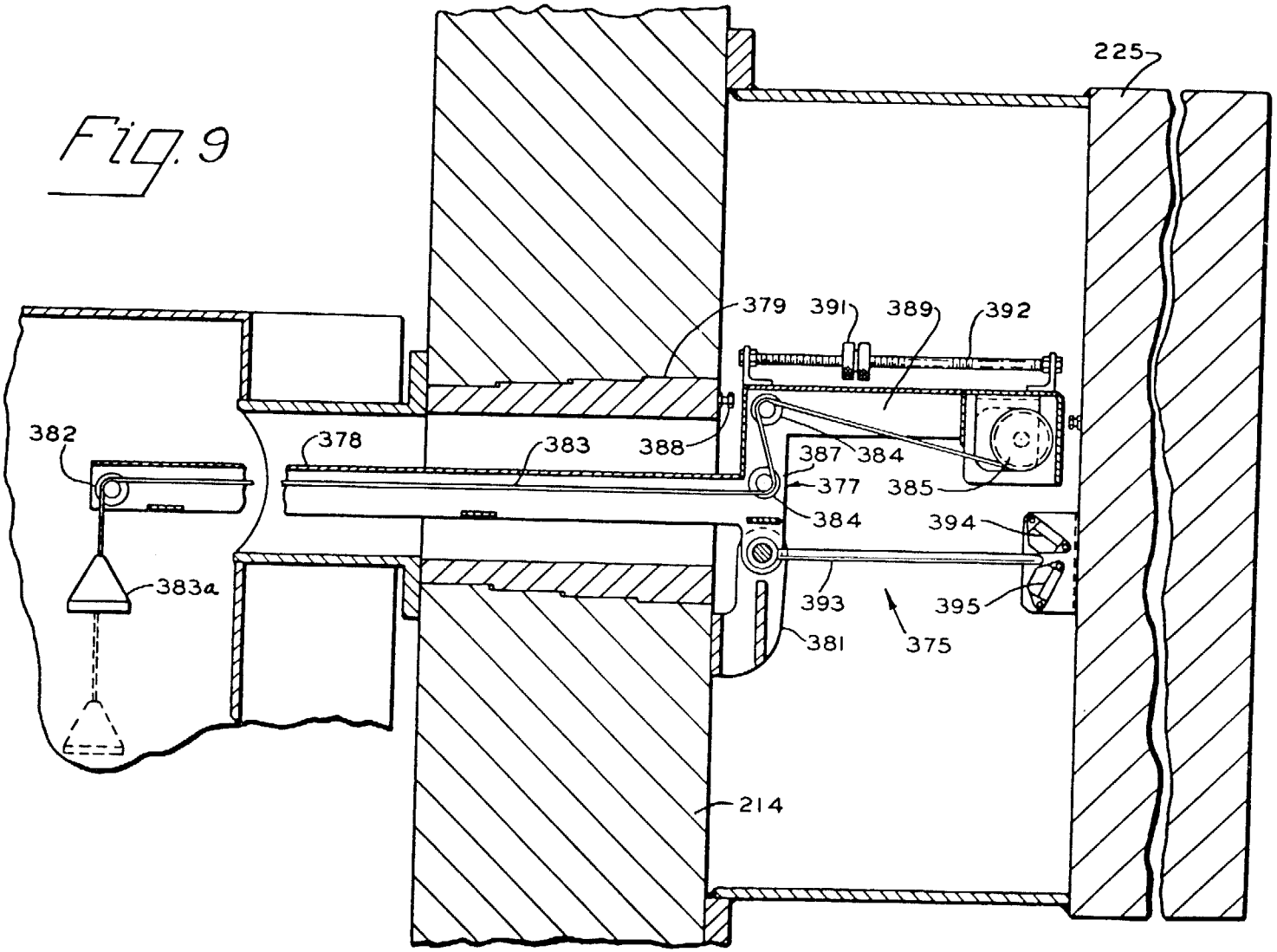
FIG. 9 is a section along line 9—9 of FIG. 7 and to the same scale.

After the proper proportion has been achieved, a proper amount of the dispersion can be caused to pass through conduit 362 from the bottom of tank 216 through metering pump 217*b* and conduit 398 to port 354*a* of filter nozzle 351 into a drum D (FIGS. 2, 3, 6).

Preferably, spray heads 399 (FIG. 1) are provided inside of the decanting tank to spray clear water to cleanse the floats 383*a* and 383*b* when they are lifted to their highest elevations; their valves can be controlled by suitable means, as from proximity switches 394.

Metering Pump

While a pump of any of various types may be employed to pump the dispersion of radioactive particles in water from the decanting tank 216 through filler nozzle 351 unto the drum D, the pump 217 is exceptionally advantageous. It delivers accurately measured quantities of liquid and thus makes possible accurate remote control of the amount of liquid passed from the decanting tank into the drum. It also makes possible the pumping of clean water for disrupting sedimentation of the particles in the tank or conduits the use of clean water for sealing purposes, and has safety features in making possible maintenance of the pump from the safe side of the shield wall 214. The pump is described in detail in our U.S. Pat No. 3,835,617.

Clean water is supplied to such spaces in all pumps 217*a*, 217*b*, 217*c* from an elevated tank 440 through an expansion tank 441 and conduit 411. Therefore, as is preferable, the clean water in these spaces at all times is at a pressure higher than the mixture of water and radioactive particles at the piston sides of the pump and its valves. Consequently, any leakage that may occur past a piston packing in the pump or a valve will be leakage of clean water into the portion of the apparatus containing the radioactive materials, and not the reverse. Consequently, there is much less opportunity for the parts including sealing rings, to pick up radioactive material and thereby make the entire assembly radioactive. This is another feature that greatly reduces maintenance problems.

Preferably, the piping may be arranged so that one valve of each pump is connected to a clean water source such as line 450, and the valves are operable either as inlet or outlet valves, so that clean water may be pumped from the source by each pump. Thus pump 217*b* can be used to pump clean water when desired back through conduit 362 into the decanting tank. This is advantageous since such back flushing can break up any mass of resin particles that may tend to settle in the decanting tank to form a cake that is difficult to start with the agitator 363. Any settling of resin particles that tends to occur, between drum fillings, in conduit 362 can also be readily disrupted to prevent clogging by pumping a small amount of liquid such as clean water back through conduit 362 by the pump. Such back pumping of clean water can also provide additional liquid for agitation in tank 216.

Pump 217*c* may be identical to that described above. This pump is adapted to accept liquid carrying evaporator bottoms (FIG. 10) from a suitable source, such as conduit 445 connected to a holding tank not shown and discharge through conduit 446 a measured quantity of such liquid through fill nozzle 351 into a drum in the drumming station.

Drumming Station Cleaning System

Spray heads 449 (FIGS. 2) connected to clean water source 440 and controlled from the control station, are provided inside of drumming equipment enclosure 226 to wash down the walls and equipment in the enclosure if desired. The spray water used flushes down the sloped bottom 451 of enclosure 226 and drains out through a bottom opening 452 into a sump tak 535 (FIGS. 1, 2, 3). This sump tank has internal baffles 454, 455 to provide a settling tank for fines that might be in the flush water, thus trapping solids that might be radioactive and that otherwise could contaminate downstream equipment if they entered a plant drain system. Excess water free of fines flows out through an overflow gate 456 into a drainage spout 457 discharging into a drain 458 located in the drumming station floor and connected to plant equipment drain system 459 that if desired may dicharge into the system for producing evaporator bottoms. The sump tank is so designed that it can be moved laterally on rollers 460 on a track 461 to a location where it can be removed by the crane. It can be placed by the crane for disposal into a drum, having a completely removable top, which top can be replaced after the sump tank and its radioactive contents, water and cement or other solidifying agent if desired, are placed in the drum.

Another drain in each drumming station floor forms part of a plant floor drain system 462 to remove liquids or wastes that may have collected on the floor, as from drum leakage or washdown of the drumming station.

The conduit system of FIG. 10 is shown for a single drumming station, but it can be duplicated. In such case lines 361, 445, 450, 459, 462 and 463 as well as other lines, can be common to two or more drumming stations.

As disclosed above, the illustrative embodiment has separate piping for each type of radioactive waste to and in the drumming station equipment, for safety and continuity of operation. The drumming apparatus 215 is completely enclosed and sealed to allow no escape or liquids, solids or gasses except through conduits planned and provided for such purposes. Thus, a vent system 463 removes and cleanses by known means, air or gases from decanting tank 216 through vent conduit 216*a*, and from drumming housing 226 through vent conduit 226*a*, as well as from other locations. The interior of housing 226, and the equipment in it, can be washed down by remotely controlled spray heads 449 for decontamination purposes if necessary.

Materials such as radioactive-containing solids washed out of the housing 226 are removed in the described removable sump by remote control. The above disclosed filling means is also designed to eliminate the possibility of radioactive waste material being spilled on the exterior of the apparatus of the drumming station by error or accident.

As disclosed, two separate and independent means are used to determine the amount of material in the drum and to prevent overfill; one means comprises metering pumps that pump accurately determined amount of fluids into the drums; the other means comprises the liquid level sensing system indicated.

In the illustrative apparatus and process, the solidifying agent, cement for example, and mixing weights are placed in the drums before they enter the system, and the drums are immediately sealed. Each drum remains sealed until the drum is opened in the drumming station immediately prior to introduction of radioactive material, after which the drum is immediately closed. This prevents entrance into the drum of undesired moisture or other contaminants that could harmfully affect the solidifying agent or other materials in the drum.

Operation of Drumming Station

A typical cycle of operations of the drumming station is as follows, assuming that the cradle frame 247 is located so its cradle 251 is properly located in position I under the hatch cover 234, the cradle being positioned in the cradle frame to receive a drum in the vertical position; the hatch cover 234 is open; and a capped drum D containing cement and mixing weights Dw is on the loading dock 241 of the drumming station to be operated as shown in broken lines in FIG. 1. The operator in the control station then controls an overhead crane (not shown) and its drum grab (not shown) to pick up the drum from the loading dock and load it into the cradle, described in U.S. Pat. No. 3,835,617. The operator then causes the hatch cover to close and the cradle frame 247 to move to position II. The clamping members are then actuated to clamp the drum. The cradle frame is then angularly moved to locate the drum at position III for cap removal. The cradle frame is then raised to cause its pin 261 to enter the socket 261*a* for position III, and to raise the drum so its cap 231 can be engaged by the wrench 332 of cap handling means 320 (FIG. 30, which is then caused to operate to remove the drum screw cap. The cradle frame 247 is then lowered, and moved angularly to the drum filling position IV.

The cradle frame is here raised to cause its pin 261 to enter the socket 261*a* for position III, and to raise the drum so the fill nozzle 351 extends into the drum. The filling cycle is then carried out as described previously by supplying a metered amount of a dispersion of radioactive particles in water from decanting tank 216 or from evaporator bottoms supply line 445.

After the proper predetermined amount of the dispersion of radioactive particles in the proper proportion of water has been put into the drum, the cradle frame is then lowered and and moved angularly to the capping position III where the cradle frame will again raise the drum so it is in capping relation to the cap handling means 320 the wrench of which is still holding the cap in a position so that when rotated the cap moves downwardly and engages the threads in the drum. The cap is then reinserted and screwed tight as described above. The wrench of the cap handling means is then released and the cradle frame lowered.

The cradle frame is next moved to position II to locate the closed drum for mixing. The drive motor 303 for rotating the cradle is then started and the drum is rotated end-over-end about axis H to mix the drum contents thoroughly, the freely movable mixing weights Dw in the drum greatly aiding thorough mixing. During the latter part of the mixing cycle, the drum may be washed as it is rotating by water sprayed from heads 449 so that drum and the interior of the drum housing 226 can be thoroughly washed down. When the mixing cycle has been completed, the mixer stops with the drum in an upright vertical position as described. Thereafter the cradle frame is released from the housing so that it may be angularly moved to position I for unloading.

Hatch cover 234 is then opened and the drum grab lowered through the hatch into the housing 226 to pick up the drum. The drum is then placed on the unloading dock 242 (FIG. 1) where its weight is checked by scale 244 and its radiation level is monitored by monitor 243 and the information transmitted electrically to the control station for recording.

The operator places another drum with its predetermined quantity of dry cement on the loading dock 241 as shown in FIG. 1 while the drum being filled is in housing 226 in its filling cycle. The scale 244 on the loading dock is used to verify the cement quantity in the drum, and the drumming apparatus is ready for the next cycle.

After the operator loads the next drum into the cradle and starts the drumming cycle, he then places the processed drum in another location for storage and brings another drum into position on the loading dock. Modifications may be made in this illustrative process of operations.

Additional disclosures

It is apparent that various modifications may be made in the illustrated system, apparatuses and processes, and also that some or all portions of the illustrated apparatus may be used for purposes other than those indicated.

As an example of modification, while in the illustrated embodiment the decanting tank 216 is located above the drumming equipment 215, the decanting tank may be located in other locations and even outside of the drumming station; or a common decanting tank such as a power plant radioactive waste storage tank could be used as a decanting tank for one or more drumming stations.

The term "fluent material' is intended to cover slurries or dispersions of particulate materials in liquids; liquids not containing particulate materials; and other flowable materials that may be handled according to the apparatus and process of the invention. The particulate materials may be of sizes different from those indicated above, as substantially larger.

While the container has been disclosed as a steel drum, it is apparent that other types of containers may be used.

Furthermore, although the invention has been discussed above in connection with the radioactive wastes resulting from boiling water or pressure water plants, the process and apparatus of the invention may be employed in connection with the disposition of other types of radioactive wastes, or radioactive wastes from other types of nuclear plants, such as those utilizing sodium or heavy water as heat transfer fluid; and the invention may be employed in connection with the handling of dangerous wastes or chemicals from other types of plants.

These and other modifications may be made in the apparatus or process disclosed, and other modifications, advantages, and modes of operation will become apparent without departing from the spirit of the invention.

Having described our invention, we claim:

1. A process of preparing a dispersion of a predetermined proportion of finely divided particles in a liquid comprising introducing a dispersion of said particles in said liquid into a container; allowing said dispersion to settle so that in the container there is a first level of a mixture and above said first level a second level of a liquid that is essentially free of said particles and of a specific gravity less than the specific gravity of the mixture of particles and liquid that has settled; sensing the vertical height location of said first level of said mixture of particles and liquid in said container, sensing the vertical height location of said second level of said liquid in said container; adjusting the amount of the liquid in said container by removing liquid between said first and second levels in accordance with the sensed heights of said first and second levels to achieve a desired proportion of total liquid to total particles in said container; and mixing the resulting mixture of particles and liquid to provide a dispersion of a predetermined proportion of said finely divided particles in said liquid to be stored in a second container.

2. The process of claim 1 in which the amount of liquid is adjusted by removing excess liquid from said container at a location above said first level and below said second level.

3. The process of claim 1 in which the dispersion of a predetermined proportion of finely divided particles in liquid is discharged into said second container by a metering pump and said pump is also used to pump excess liquid from said first mentioned container.

4. The process of claim 3 in which said metering pump is also used to feed water to the bottom of said first mentioned container to effect back flushing thereof.

5. The process of claim 1 comprising placing sensing means in said liquid in said container to determine and indicate the location of said first level of the mixture of particles and liquid and to determine and indicate the location of said second level of liquid in said container, adjusting the amount of liquid by removing liquid between said first and second levels in said container in accordance with the indications of said sensing means, and removing said sensing means above the said second level of liquid in said container before mixing said mixture of particles and liquid to provide said dispersion.

6. The process of claim 5 in which said sensing means comprises floats having different specific gravities.

7. The process of claim 5 in which sensing means is placed in said container to determine the height of said second level of liquid as it is lowered by removal of excess liquid and in which such removal is halted when such height is at a predetermined amount as determined by said sensing means.

8. The process of claim 5 in which a decanting pipe with a movable inlet is located in said container with its inlet below said second level, and said inlet is moved in an upright path during removal of excess liquid through said pipe.

9. The process of claim 8 in which said sensing means and said decanting pipe are held out of the liquid in said container during said mixing.

10. The process of claim 5 in which said sensing means transmit signals to a remote location outside of said container to indicate the location of said first level and said second level, and the amount of liquid between said first and second levels in said container is adjusted from said remote location from the indication of said signals.

11. The process of claim 10 in which said particles are radioactive particles.

12. The process of claim 11 in which the radioactive particles and liquid are thoroughly mixed to provide a dispersion which is discharged from said container in an accurately measured amount into a storage container.

13. The process of claim 11 in which the dispersion of a predetermined proportion of radioactive particles in liquid is thoroughly mixed and pumped from said container in measured amounts after the amount of said liquid is adjusted, thereafter a dispersion containing more of said radioactive particles and excess liquid is fed to said container, and the process is repeated.

* * * * *

UNITED STATES PATENT AND TRADEMARK OFFICE

CERTIFICATE OF CORRECTION

PATENT NO. : 4,030,708

DATED : June 21, 1977

INVENTOR(S) : Arthur J. Stock, Donald E. Christofer, Joseph E. Brinza

It is certified that error appears in the above-identified patent and that said Letters Patent are hereby corrected as shown below:

Column 4, line 8, "pump" should be --pumps--;

" " " 30, "grounted" should be --grouted--;

Column 5, line 31, "station" was omitted after --control--.

Column 6, line 40 "3093" should be --309e--;

" " " 54, "screw" should be inserted before --cap--.

Column 7, line 22, "gaged" should be --gages--;

" " " 62, "carried" should be --carries--.

Column 8, line 27, "carried" should be --carries--;

" " " 46, after "level" insert --L--.

Column 9, line 28, "filter" should be --filler--.

UNITED STATES PATENT AND TRADEMARK OFFICE

CERTIFICATE OF CORRECTION

PATENT NO. : 4,030,708

DATED : June 21, 1977

INVENTOR(S) : Arthur J. Stock, Donald E. Christofer, Joseph E. Brinza

It is certified that error appears in the above-identified patent and that said Letters Patent are hereby corrected as shown below:

(continued)

Column 10, line 29, "tak 535" should be --tank 453--;

" " " 61, "or" should be --of--.

Column 11, line 49, "Fig. 30," should be --(Fig. 3)--.

Signed and Sealed this

Sixth Day of March 1979

[SEAL]

*Attest:*

RUTH C. MASON
*Attesting Officer*

DONALD W. BANNER
*Commissioner of Patents and Trademarks*